United States Patent [19]

Van Riemsdyck

[11] 4,034,425

[45] July 12, 1977

[54] BATHTUBE SLIDE DEVICE

[76] Inventor: Aaltje Van Riemsdyck, 218 23 82nd Ave., Queens Village, N.Y. 11427

[21] Appl. No.: 721,427

[22] Filed: Sept. 8, 1976

[51] Int. Cl.[2] ..... A47K 3/12

[52] U.S. Cl. ..... 4/185 R; 4/185 S

[58] Field of Search ..... 4/185 R, 185 S–185 HB

[56] References Cited

U.S. PATENT DOCUMENTS

| | | | |
|---|---|---|---|
| 1,188,534 | 6/1916 | Corwin | 4/185 S |
| 1,197,657 | 9/1916 | Orofino | 4/185 S |
| 3,193,848 | 7/1965 | Levy | 4/185 S |

FOREIGN PATENT DOCUMENTS

| | | | |
|---|---|---|---|
| 77,529 | 5/1954 | Denmark | 4/185 S |

*Primary Examiner*—Henry K. Artis

[57] ABSTRACT

A bathtub support device with support means and a lower seat and an upper seat extending vertically above the lower seat with securing means associated with the respective terminal ends of the support means. Upper and lower gripping means is associated with the respective seats on each side thereof for gripping by the user of the support.

10 Claims, 4 Drawing Figures

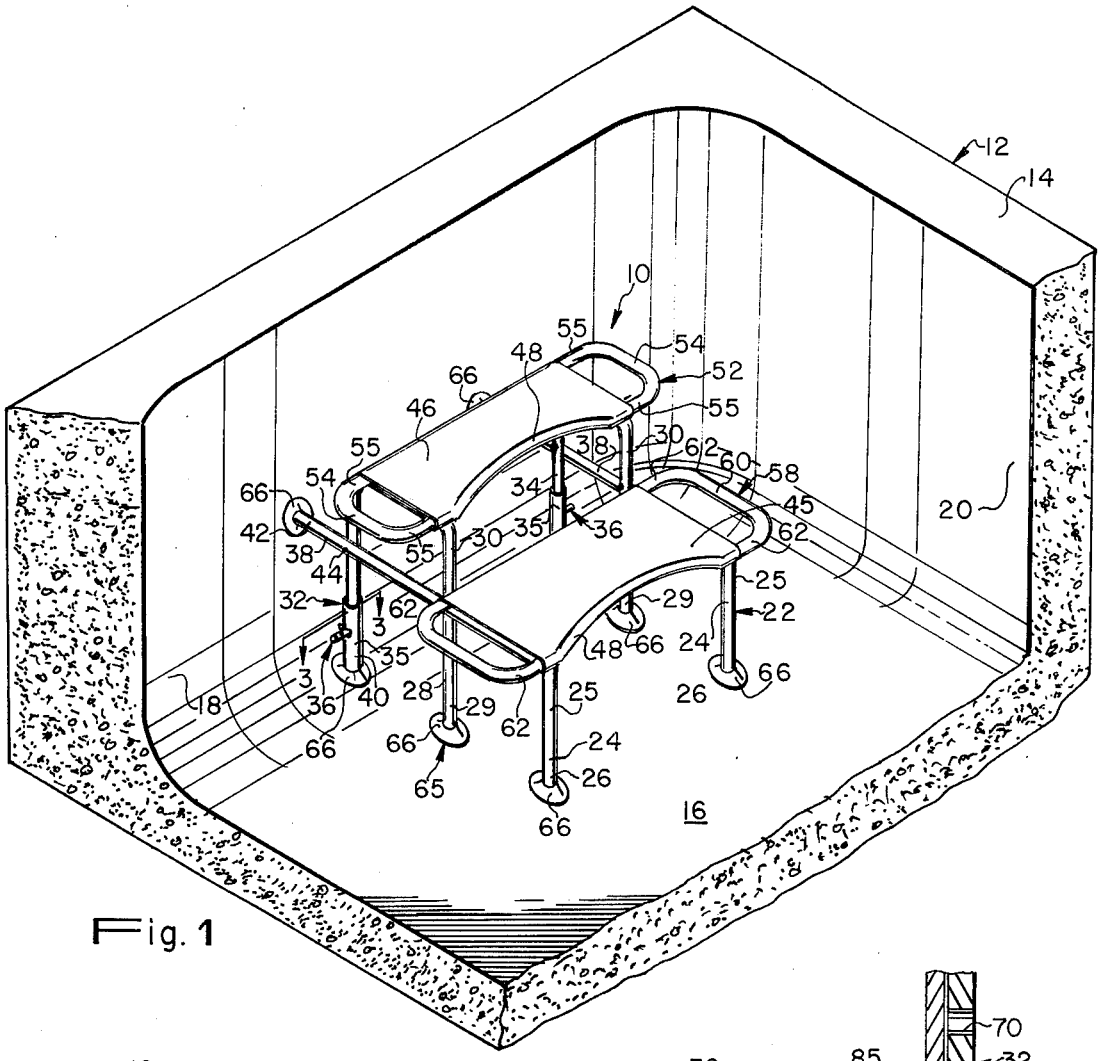
Fig. 1
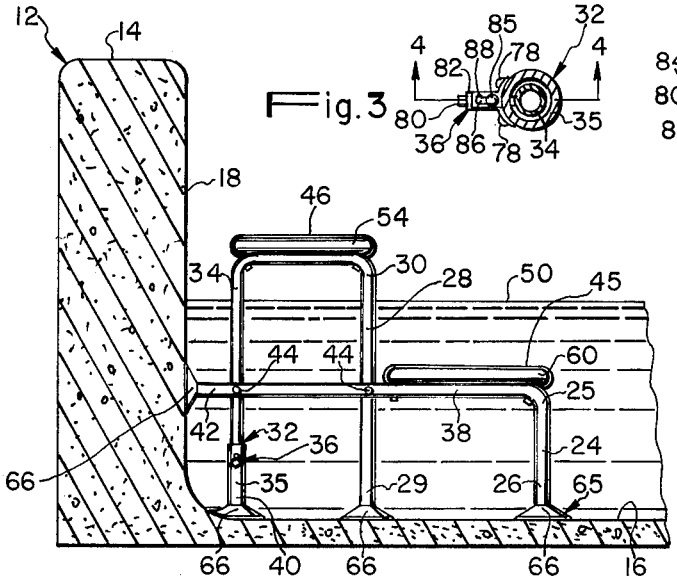
Fig. 2
Fig. 3
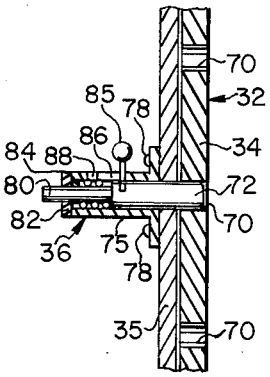
Fig. 4

BATHTUBE SLIDE DEVICE

BACKGROUND OF THE INVENTION

The present invention relates to safety supports for use in bathtubs and which are particularly designed for use by senior citizens to enhance comfort in bathing as well as ingress into a bathtub and egress from the tub.

Particularly with senior citizens, and younger individuals as well, it is desirable to provide means for supporting the bather during the bath as well as providing an ability to have support during the bath as well. By having a support within the bathtub, it permits the user to soak only a part of their body while the rest of their body may stay above the water line. Although a variety of mats have been proposed, they are not designed to accommodate the entire body in various positions.

OBJECTS OF THE INVENTION

An object of the present invention is to provide a support to be positioned in a bathtub and also easily removed from the bathtub after use thereof.

Another object of the present invention is to provide a support that has two levels on which the user may rest.

Another object of the present invention is to provide a support that is adjustable in height at one end thereof to adjust to the slope of the bathtub as well as being able to angularly position the bathtub support device therein.

Another object of the present invention is to provide a support device which is of simple and economical construction.

Other objects and advantages of the present invention will become apparent as the disclosure proceeds.

SUMMARY OF THE INVENTION

A bathtub support device is disclosed that includes support means having a first pair of vertically disposed spaced apart support members extending upwardly from the bottom of the bathtub, and a pair of vertically disposed spaced apart legs extending upwardly from the bottom of the bathtub and above the first pair. Horizontally disposed coupling members rigidly connect each pair of the support members and the support legs with one end of the coupling members adapted to be positioned adjacent the bathtub wall.

A lower seat extends between the horizontally disposed spaced apart coupling members, with an upper seat extending vertically above the lower seat and between the spaced apart legs. Securing means associated with the respective terminal ends of the support members, legs, and coupling members to removably secure the bathtub support to the bottom and side of the bathtub for retaining the support in position in the bathtub during use thereof is provided. The securing means includes vacuum cups mounted on the respective terminal ends.

Upper gripping means associated with the upper seat and extending on each side thereof and connected to the support legs for gripping by the user of the support is provided with lower gripping means associated with the lower seat and extending on each side thereof.

BRIEF DESCRIPTION OF THE DRAWING

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1 is a persepctive view showing the bathtub support device positioned in a bathtub in accordance with the present invention;

FIG. 2 is a side view illustrating the bathtub support device;

FIG. 3 is a sectional view taken along lines 3—3 of FIG. 1; and

FIG. 4 is an enlarged fragmentary sectional view taken along lines 4—4 of FIG. 3.

DETAILED DESCRIPTION OF THE PREFERRED EMBODIMENT

Referring to the drawings, and initially FIGS. 1 and 2 thereof, there is illustrated a bathtub support device that will be fabricated from a non-corrosive metal material or plastic, or any combination thereof. The bathtub support device 10 is positioned within a bathtub 12 having an upper end 14 with a spaced apart bottom end 16 and a vertically extending end wall 18 and side wall 20.

The support means 22 includes a first pair of vertically disposed spaced apart support members 24 having an upper end 25 and terminal or lower end 26. The support means 22 further includes a second pair of vertically disposed spaced apart support members 28 extending upwardly from the bottom 16 of the bathtub 12 and having a terminal or lower end 29 and an upper end 30 that exceeds the vertical height of the upper end 25 of the first support member 24. The support means 22 further includes a pair of vertically disposed spaced apart legs or members 32 extending upwardly from the bottom of the bathtub 16 and substantially to the same level as the second support members 28.

Each of the legs 32 includes an upper leg portion 34 and a lower leg portion 35 mounted in telescopic relationship to the upper leg portion 34 and longitudinally adjustable relative thereto. Mounted in operative relationship to each of the leg assemblies 32 are releasably connecting means 36, hereinafter discussed with respect to FIGS. 3 and 4 for connecting the lower leg portion 35 to the upper leg portion 34 at various extended positions.

To provide a rigid framework between the respective support members 24 and 28 as well as the legs 32, which may be constructed of a tubular material, horizontally disposed coupling members 38 rigidly connect each pair of the support members 24 and 28 together as well as the support legs 32. The bottom or lower end 40 of the lower leg portion 35 extends in substantially the same plane as the terminal end 29 and 26. The coupling member 38 extends in a substantially horizontal plane and may be integrally formed with the first support members 24 at one end thereof and extending beyond the leg members 32 by several inches, or more, with the terminal end 42 extending adjacent the wall 18 of the bathtub 12. In this manner by providing fasteners, such as rivets 44, between the overlapping cross points between the support legs 32 and second support members 28 a rigid structure is obtained to be positioned within the bathtub 12 as illustrated in FIG. 1.

To support the user during use of the device 10 a lower seat 45 is provided that is rigidly mounted in horizontally disposed relation between the spaced apart coupling member 38. An upper seat 46 is provided extending vertically above the lower seat 45 and between the spaced apart legs 32 and support members 28. The respective seats 45 and 46 may be made out of a soft material on which the user may rest and be provided with an inwardly formed leading edge 48 that is contoured to fit the legs of the user. By providing the front contour 48 on the upper seat 46, it is also possible to dangle one's legs into the water 50 above the water line or the user may place his feet on the lower seat 45.

It is most important considering the number of accidents that annually occur by people getting in and out of bathtubs to provide means to be grasped by the user of the device 10. Accordingly, upper gripping means 52 is associated with the upper seat 46 and extending on each side thereof and connected to the support legs 32 and support members 28. The upper gripping means 52, which extends outwardly from the seat 46, includes a gripping member 55 on each side of the seat 46 with a connecting arm 54 which may be integrally formed with the gripping member 55 and extend across the spaced apart legs 32 and support members 28 to form the frame on which the seat 46 is positioned. The seat 46 may be wrapped around the frame formed by the connecting arms 54.

In similar fashion lower gripping means 58 is associated with the lower seat 45 and extends outwardly therefrom on each side thereof. The lower gripping means 58 includes spaced apart gripping members 60 with horizontally extending connecting arms 62 on which the lower seat 45 may extend therearound. In this manner the user positioned on either seat or in making the transition from the upper seat 46 to the lower seat 45 may easily grasp the hand rail portion 54 and 60 of the respective gripping means 52 and 58.

To prevent movement of the device 10 when positioned within the bathtub 12, securing means 65 is provided and is associated with the respective terminal ends 26 of the support members 24, terminal ends 29 of the support members 28, terminal ends 40 of the legs 32, and terminal ends 42 of the coupling members 38. By providing this arrangement of securement to both the bottom 16 and wall 18 of the bathtub 12, proper retention is obtained to overcome the forces applied to the device 10 by users of various body weights. The respective terminal ends may each have thereon vacuum cups 66 that easily and quickly provide the necessary coupling relationship to obtain the desired retention of the device 10 as required.

Due to the fact that various manufacturers design and construct bathtubs having various sloping angles, it has been found desirable that the legs 32 be adapted to be longitudinally adjustable so as to maintain the terminal ends 40 of the lower leg portion 35 in the necessary horizontal plane as the terminal portion 29 and 26. In this manner the proper suction force is maintained between the suction cups 66 mounted on the leg lower portion 35.

As seen in FIGS. 3 and 4, the lower leg portion 35 extends in telescopic relationship to the upper leg portion 34. The upper leg 34 may be provided with spaced apart openings 70 extending vertically along the length thereof and adapted to receive therein a member or pin 72 forming part of the releasably connecting means 36. The member or pin 72 is utilized for bridging between an interconnecting the upper leg portion 34 with the lower leg portion 35 which are in telescopic relationship to each other. The pin 72 is mounted within a housing secured to the lower leg portion 35 by fastener elements 78. The pin 72 has a guide pin 80 extending from one end thereof and outwardly through a wall portion 82 mounted at the rear of the housing 75 with a compression spring 84 mounted around the guide pin 80 which tends to move the pin 72 into the aperture 70. A manually operable lever 85 extends through a longitudinal slot 86 provided in a housng 75. The slot 86 has a laterally extending portion 88 which is adapted to receive a lever arm 90 that extends between the pin 72 and the operable lever 85. By turning pin 72 by means of the operable lever 85, it is possible to bring the pin 72 either into or out of engagement with the upper leg portion 34. In practice, the manually operable lever 85 is manipulated through the outer end of slot 86 into the laterally extending portion 88 to retract the pin 72 from engagement in a registered aperture 70. If reengagement is desired the lever arm 85 is thereafter rocked to interengage in slot 86 to latch the upper leg portion 34 as desired. In this manner the height of the overall leg 32 may be adjusted to varying heights or levels and the bridging member 72 is movable between extended and retracted positions such that in the extended position as seen in FIG. 4 the interconnecting bridging relation is obtained.

Although an illustrative embodiment of the invention has been described in detail herein with reference to the accompanying drawings, it is to be understood that the invention is not limited to the precise embodiment, and that various changes and modifications may be effected herein without departing from the scope or spirit of the invention.

I claim:

1. A bathtub support device, comprising:

a. support means which comprises i. a first pair of vertically disposed spaced apart support members extending upwardly from the bottom of the bathtub, ii. a pair of vertically disposed spaced apart legs extending upwardly from the bottom of the bathtub and above said first pair, iii. horizontally disposed coupling members rigidly connecting each pair of said support members and said support legs with one end of said coupling members adapted to be positioned adjacent the bathtub wall, b. a lower seat extending between said horizontally disposed spaced apart coupling members, c. an upper seat extending vertically above said lower seat and between said spaced apart legs, d. securing means associated with the respective terminal ends of said support members, support legs, and coupling members to removably secure the bathtub support to the bottom and side of the bathtub for retaining the support in position in the bathtub during use thereof, said securing means including vacuum cups mounted on said terminal ends, e. upper gripping means associated with said upper seat and extending on each side thereof and connected to said support legs for gripping by the user of the support, and f. lower gripping means associated with said lower seat and extending on each side thereof.

2. A bathtub support as defined in claim 1, and further including:

a. a second pair of vertically disposed spaced apart support members extending upwardly from the bottom of the bathtub between said first pair of support members and said support legs, said second pair of support members connected to said coupling members, and b. vacuum cups mounted on the terminal ends of said second support members for securement to the bottom of the bathtub.

3. A bathtub support as defined in claim 1, wherein said upper and lower seats have an inwardly formed leading edge to facilitate positioning the body of the user with respect thereto.

4. A bathtub support as defined in claim 1, wherein said lower and upper gripping means extends outwardly from its respective seat.

5. A bathtub support as defined in claim 4, wherein each said gripping means includes a gripping member extending in spaced relation to each end of each respective seat for gripping by the hand of the user.

6. A bathtub support as defined in claim 1, wherein each of said leg members includes:

a. an upper leg portion connected at one end to said upper seat, b. a lower leg portion mounted in telescopic relationship to said upper leg portion and longitudinally adjustable relative thereto, and c. means for releasably connecting said lower leg portion to said upper leg portion at various extended positions.

7. A bathtub support as defined in claim 5, wherein said releasably connecting means includes a member for bridging between and interconnecting said upper leg portion and said lower leg portion.

8. A bathtub support as defined in claim 6, wherein said bridging member is movable between extended and retracted positions, in extended position bridging the adjacent free ends of said leg portions for interconnecting the latter, said bridging member, in the retracted position, being disposed inwardly of said leg portions and out of bridging relation with the other leg portion.

9. A bathtub support as defined in claim 1, a. and further including a second pair of vertically disposed spaced apart support members extending upwardly from the bottom of the bathtub between said first pair of support members and said support legs, said second pair of support members connected to said coupling members, and vacuum cups mounted on the terminal ends of said second support members for securement to the bottom of the bathtub, b. wherein said lower and upper gripping means extends outwardly from its respective seat, and said gripping means includes a gripping member extending in spaced relation to each end of each respective seat for gripping by the hand of the user, c. wherein each of said leg members includes

1. an upper leg portion connected at one end to said upper seat, ii. a lower leg portion mounted in telescopic relationship to said upper leg portion and longitudinally adjustable relative thereto, means for releasably connecting said lower leg portion to said upper leg portion at various extended positions, and iv. wherein said releasably connecting means includes a member for bridging between and interconnecting said upper leg portion and said lower leg portion.

10. A bathtub support as defined in claim 9, wherein said bridging member is movable between extended and retracted positions, in extended position bridging the adjacent free ends of said leg portions for interconnecting the latter, said bridging member, in the retracted position, being disposed inwardly of said leg portions and out of bridging relation with the other leg portion.

* * * * *